United States Patent [19]

Matusewicz et al.

[11] 4,149,577

[45] Apr. 17, 1979

[54] CANT FORMING MACHINE

[76] Inventors: William P. Matusewicz, Brooks Rd., Templeton, Mass. 01468; Robert J. Matusewicz, 505 Hillsmere Dr., Annapolis, Md. 21403

[21] Appl. No.: 780,699

[22] Filed: Mar. 24, 1977

[51] Int. Cl.[2] ..... B27B 7/02; B27B 29/08; B27C 9/00

[52] U.S. Cl. ..... 144/39; 144/312; 144/41; 144/326 R; 83/730; 83/425.3

[58] Field of Search ..... 144/312, 39, 41, 326, 144/3 R, 1 R; 83/707, 425.3, 730, 731

[56] References Cited

U.S. PATENT DOCUMENTS

| | | | |
|---|---|---|---|
| 3,180,377 | 4/1965 | Pinder | 83/730 |
| 3,313,329 | 4/1967 | Mitten | 144/312 |
| 3,357,368 | 12/1967 | Fonden | 198/719 |
| 3,472,296 | 10/1969 | Johnson | 144/326 R |
| 3,920,058 | 11/1975 | Walker | 144/312 |
| 3,934,630 | 1/1976 | Cockle | 144/39 |

*Primary Examiner*—Donald R. Schran
*Attorney, Agent, or Firm*—Charles E. Brown

[57] ABSTRACT

This disclosure relates to a cant forming machine wherein logs are cut in advance to the predetermined length of the wood slats and pieces to be formed, after which the logs are automatically moved through a series of saws and molding heads to first cut guide grooves in the lower portion of each log, after which the log is moved onto guides where it is under full control. Following this, necessary cuts are made in the log to define a plurality of cants, followed by a final cutting of the log to separate the plural cants. The machine is adapted to continuously receive cut lengths of logs with there being conveyor means for presenting logs to the machine and a cut-off saw for cutting the logs to the predetermined length. Also, the machine has a reciprocating pusher carried by an endless conveyor chain with the pusher being connected to the conveyor chain in a manner wherein the conveyor chain may slip relative thereto in the event of a jam.

13 Claims, 11 Drawing Figures

CANT FORMING MACHINE

This invention relates in general to new and useful lumber forming machines and more particularly to a machine for forming cants of predetermined lengths for further sawing into boards and pieces of the required dimension. The machine is particularly adapted for forming cants to be sliced into slats and frame pieces of pallets.

Heretofore complexed holding means have been required to first hold a log so that it may be generally squared after which the squared log is passed through the usual source for cutting the same into cants. The squaring of the log necessarily results in the waste of a considerable portion of the periphery of the log.

It is also known to cut grooves into logs and thereafter move the logs onto guides received in the grooves. However, in the past when grooves have been so formed, they have served solely the purpose of guiding the logs and in the further operations on the logs, the guide grooves have been removed before the logs are passed into the usual cant forming saws. This has also resulted in the waste of material.

In accordance with this invention, it is proposed to place a log in a trough, after which a pusher automatically picks up the log and while the log is still supported in the trough, a pair of saws engage the lower portion of the log on opposite sides thereof and cuts a pair of guide grooves therein. The leading portion of the log immediately engages guides which pass into the grooves cut by the saws so that control of the movement of the log at all times is maintained. The first cuts in the log are in fact cant defining cuts os that the cuts are in no way wasted.

After the log has passed onto the stationary guides, a molding head forms a flat on the bottom of the log, which flat is to be utilized later in the supporting of the log during the terminal portion of the cant forming operation. The flat formed on the bottom of the log is spaced below the first cuts and may, in certain instances, be utilized in defining pieces which may be utilized, for example, as grade stakes.

When the lower portion of the log is to be utilized as grade stakes, a pair of vertically disposed molding heads engage the log and form vertical finished surfaces on the log on opposite sides thereof and below the first saw cuts.

In the next operation, the log is passed through multiple horizontally disposed gang saws so as to define a plurality of vertically spaced cants all disposed on opposite sides of a central vertically disposed cant. Finally, a pair of vertical saws are engaged by the log at a time when the forward portion of the log is supported on a horizontal support bar and vertically cut the log on the opposite sides of the central cant, automatically dividing from the log the plurality of horizontally disposed cants and the lower pieces. The resultant cants now may be placed in a conventional gang saw slicing apparatus for forming the desired width slats and other pieces.

The log is pushed through the entire machine by a reciprocating pusher which is carried by an endless chain. The endless chain is connected to the pusher by means of a slip connection wherein when jams, occur, the pusher may remain stationary even though the chain is being driven. Further, the pusher is pivotally mounted so that is may reciprocate back over a log already positioned for movement through the machine with the pusher hinging upwardly to ride over the log.

With the above and other objects in view that will hereinafter appear, the nature of the invention will be more clearly understood by reference to the following detailed description, the appended claimed subject matter, and the several views illustrated in the accompanying drawings.

Figures 1, 2, 3, 4, 5:
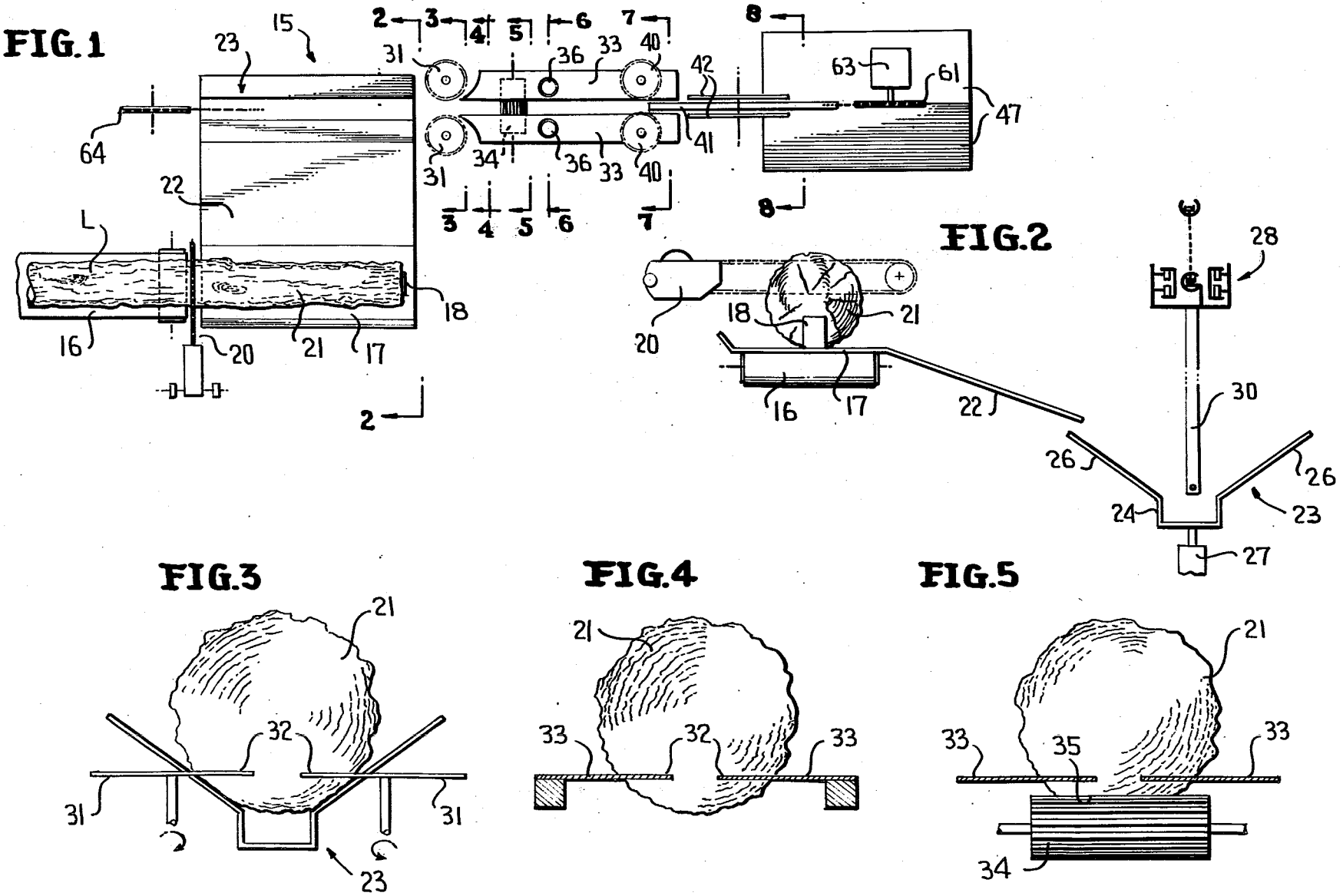
FIG. 1 is a schematic top plan view of the cant forming machine an shows generally the arrangement of components thereof.
FIG. 2 is a schematic vertically sectional view taken generally along the line 2—2 of FIG. 1 and shows the manner in which a log may be cut to length and then moved into a trough for engagement by the conveyor means for movement through the remainder of the cant forming machine.
FIG. 3 is a schematic transverse vertical sectional view taken generally along the line 3—3 of FIG. 1 and shows the formation of initial guide cuts in the log.
FIG. 4 is an enlarged schematic sectional view taken along the line 4—4 of FIG. 1 and shows the log supported by guides received in the first saw cuts.
FIG. 5 is an enlarged schematic sectional view taken along the line 5—5 of FIG. 1 and shows a lower molding head forming a flat on the underside of the log.

Referring now to the drawings in detail, it will be seen that there is illustrated a cant forming machine formed generally in accordance with this invention, the machine being generally identified by the numeral 15. It is to be understood that the cant forming machine 15 is constructed to take logs of a predetermined length and to cut the logs into cants and pieces which may be further cut, as necessary into slats or boards and other pieces of predetermined cross-sections. The illustrated machine is particularly adapted for cutting pieces in the formation of pallets, which pieces have a nominal width or height on the order of four inches. Accordingly, the cants cut in accordance with this disclosure would have a width of four inches. However, this dimension is in no way limiting as far as the machine is concerned.

In accordance with this invention, a log L of handable size, that is one which may be readily carried on a truck, is moved by means of a horizontal conveyor 16 onto a table 17 whereat it engages a stop 18. Movement of the conveyor 16 is then stopped and an operator actuates a cut-off saw 20 so as to cut the log L into a smaller log 21 of a predetermined length. It is to be understood that the saw 20 and the conveyor 16 may be manually actuated in any desired manner.

As is best shown in FIG. 2, the table 17 is slightly sloped towards the remainder of the machine 15 so that once a logs length 21 has been cut, it will roll off of the table 17, down a chute 22 and into a trough, generally identified by the numeral 23 of the machine 15 for movement through the machine.

As is clearly shown in FIGS. 1 and 2, the trough 23 includes a central channel member 24 and a pair of downwardly and inwardly sloping side plates 26. The trough 23 is configurated to receive logs of a diameter varying from eight to twenty inches. The trough 23 is carried by vertically adjustable supports 27 which may be in the form of fluid cylinders. The adjustability of the supports 27 is for the purpose of vertically adjusting the trough 23 in accordance with the diameter of the log portions which are to be sawed into cants.

The machine 15 includes a suitable conveyor mechanism, generally identified by the numeral 28, which is disposed over the machine proper and includes a depending pusher 30 which will engage an end of a log piece sitting in the trough 23 and advance the same longitudinally of the trough automatically.

Referring now to FIG. 3, it will be seen that the log portion 21 is moved longitudinally through the trough 13 into engagement with a pair of horizontally disposed, rotary saws 31. The saws 31 form in the lower part of the log 21 at opposite sides thereof horizontal saw cuts or slits 32. The saw cuts 32 are transversely spaced a distance corresponding to the width or thickness of a central cant which will be formed hereinafter. Further, the saw cuts 32 have a dual function as will be described hereinafter.

Referring now to FIG. 4, it will be seen that as soon as the log 21 passes the saws 32, it becomes engaged with a pair of guide plates 33 which lie in a common plane with the rotary saw blades 31 and are disposed immediately downstream of the saw blades. As is best illustrated in FIG. 1, the leading edges of the guide plates 33 are arcuate, generally conforming to the periphery of the associated one of the saws 31. It will be readily apparent that once the guide plates 31 enter into the saw cuts 32, absolute control over the log portion 21 is obtained.

After control of the log portion 21 is obtained by way of the guide plates 33, the underside of the log is engaged by a horizontally disposed milling head 34 which mills onto the underside of the log portion 21 a flat 35. The purpose of the flat 35 will become apparent hereinafter.

Figure 6:
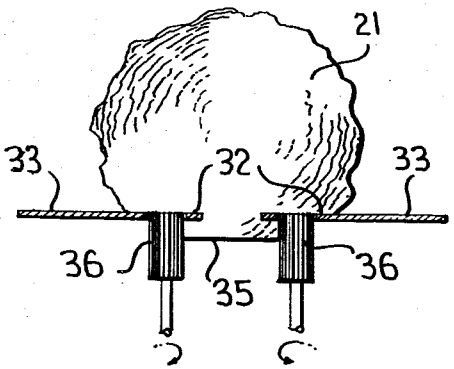
FIG. 6 is an enlarged schematic sectional view taken along the line 6—6 of FIG. 1 and shows vertical molding heads facing the lower portion of the log below the initial saw cuts on opposite sides of the log.

Referring now to FIG. 6, it will be seen that downstream of the horizontal milling head 34, the machine 15 includes a pair of vertical milling heads 36 which are disposed equally in distance on opposite sides of the center of the log portion 21. The milling heads 36 extend up through suitable holes in the guide plates 33 so as to vertically mill the lower part of the log portion 21 up to the top thereof next to the slits 32. The purpose of this milling of the log portion 21 will become apparent hereinafter.

Figure 7:
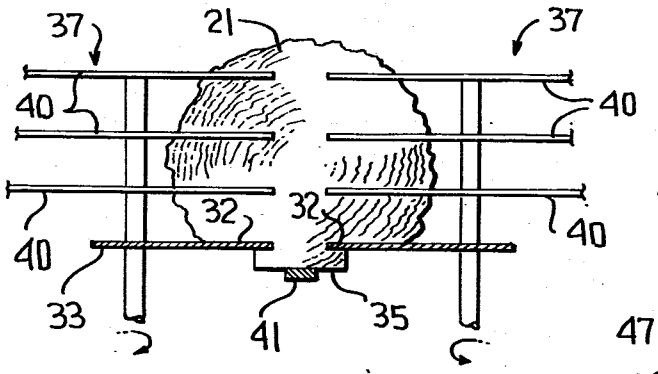
FIG. 7 is an enlarged schematic vertical sectional view taken along the line 7—7 of FIG. 1 and shows the passage of the log through gang saws for the purpose of cutting the log into vertically spaced cants.

With reference to FIG. 7, it will be seen that the log portion 21 is next advanced through two sets of gang saws, each generally identified by the numeral 37. Each gang saw 37 includes a vertical shaft 38 and a plurality of horizontally disposed, vertically spaced rotary blades 40. The blades 40 are spaced so as to form cants of desired width or thickness and the lowermost one of the blades 40 is spaced above the saw cuts 32 a distance to form a lowermost cant of the desired width or thickness. It is also to be noted that the opposed edges of the blades 40 are spaced apart the same distance as are the blades 31 so as to retain intact the central cant which is to be cut from the log portion 21.

Disposed in longitudinal overlapping relation with respect to the guide plates 33 is a support bar 41 which is positioned for engaging the underside 35 of the log portion 21. It is to be noted here that the support bar 41 supports the central cant at such time as the other cants are cut from the log portion 21.

Figure 8:
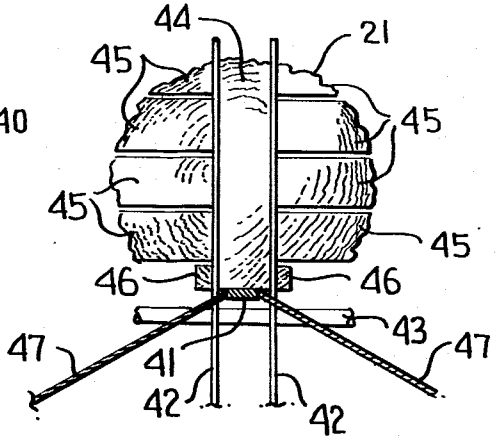
FIG. 8 is an enlarged schematic transverse vertical sectional view taken along the line 8—8 of FIG. 1 and shows the log being passed through a pair of vertical saws which cuts the log into a central vertical cant, cants disposed on opposite sides of the vertical cant, and into two smaller pieces.

Referring now to FIG. 8, it will be seen that the log portion 21 is next advanced into a pair of vertical rotary saw blades 42 which are carried by a horizontal shaft 43. The saw blades 42 are spaced apart a distance so as to intersect the saw cuts 32 and the saw cuts formed by the blades 40 at their inner ends. The spacing of the saw blades 42 is also in accordance with the width or thickness of the desired central cant. The saw blades 42 are effective to divide the log portion 21 into a central cant 44, a plurality of said cants 45 and a pair of stakes 46. The stakes 46 and the cants 45 may fall down suitable chutes 47 disposed on opposite sides of the support bar 41. The central cant 44 will also fall off of the support bar 41 for collection.

It is to be noted that up to this point very little of the log portion 41 has been removed as chips. The stakes 46 are of the desired cross-section and need only to be cut to length and pointed. As to the cants 44 and 45, these cants are ready to be delivered to a gang saw for cutting into boards or other lumber pieces. It is to be understood that for all practical purposes, all of the wood of the cant 44 may be utilized. The same is also true of all except the upper ones of the cants 45. However, it will be readily apparent that the desired boards and wood pieces may be cut from the cants 44 and 45 with a minimum of waste.

At this time it is also pointed out here that by not having to square the sides of the log portion 21 to a predetermined rectangular size, there is no waste of logs as between smaller logs and larger logs. Further, because of the fact that the log is under absolute control after it passes onto the guide plates 33, it is immaterial as to whether the log is crooked or straight. Of course, with the straight log more usable wood is available. On the other hand, with respect to a crooked log, a greater proportion than usual is obtainable from a crooked log.

It will also be noted that there is no lost saw actions. In other words, the saw cuts formed by the blades 31 are utilized both for the purpose of guiding the log portion 21 and for forming a surface of a cant. Therefore, there is no wasted motion with respect to the forming of saw cuts for guiding purposes and then removing the same as is common in the prior art.

It is to be understood that the pusher 30 is mounted for reciprocation back and forth over the machine 15. Further, the pusher 30 is pivotally mounted with respect to its carrier so that during its return movement it will pivot and ride over a log already positioned in the trough 23 and after it has ridden over that log, it will drop behind the logs so that when its direction of movement is reversed from rearward to forward, it will engage the log and push the same out of the trough.

More specifically, the conveyor 28 includes a pair of longitudially extending supports 50 which are of channel cross-section. The supports 50 carry for longitudinal movement a carrier 51 which is preferably of a U-shaped configuration. The carrier 51 includes a horizontal part 52 and a pair of vertical legs 53. Each vertical leg 53 carries two sets of rollers or wheels with each set of rollers or wheels including an upper roller 54 and a lower roller 55. The rollers 54 and 55 engage the flanges of the channels 50 and serve to support the carrier 51 for movement longitudinally of the machine.

The pusher bar 30 is carried by a hanger 56 which is pivotally mounted on the carrier 51 by means of a horizontal shaft 57. The hanger 56 is free to rotate in a counter clockwise direction to permit the pusher bar 30 to ride back over the log portions, and is provided with suitable stop means (not shown) which will retain the pusher bar 30 in a vertical position when it is to push a log portion. In order to facilitate the anchoring of the pusher bar 30 to a log portion, the forward face thereof is provided with a pin 58 which may penetrate into the end of the log portion which is being pushed.

Figure 9:
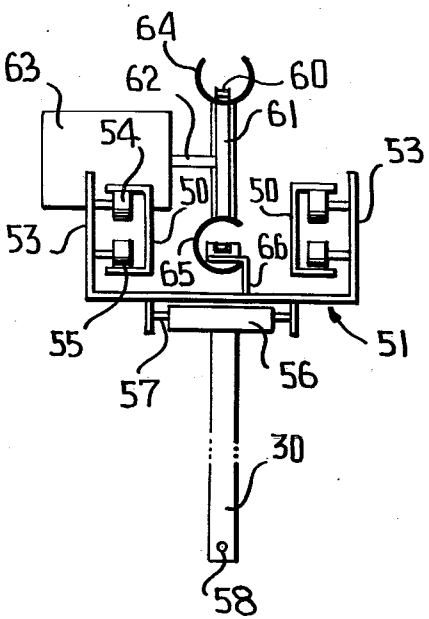
FIG. 9 is an enlarged fragmentary transverse sectional view taken through an upper portion of the cant forming machine and shows the details of the conveyor for moving logs therethrough.

It is to be understood that the carrier 51 is reciprocated by means of an endless chain 60. The endless chain 60 is entrained over a drive sprocket 61 carried by a shaft 62 of a drive motor 63, and by an idler sprocket 64, as is best shown in FIGS. 1 and 9. It is to be understood that the motor 63 will be controlled by conventional limit switches (not shown) engageable by the carrier 51. It is also to be understood that the drive motor 63 preferably is of a two speed construction. The advance movement of the pusher bar is to be that desired for the machine 15 and the reverse movement of the pusher bar 30 is to be much faster so as to have a minimum time between following log portions.

The conveyor chain 60 is housed within two generally U-shaped housing 64 and 65. The housing 64 is vertically disposed while the housing 65 is horizontally disposed. The lower run of the chain 60 is coupled to a drive member 66 which is carried by the carrier 51. The connection between the angle member 66 and the conveyor chain 60 is a slip connection as will be described in more detail, the slip connection being generally identified by the numeral 67 and illustrated more specifically in FIG. 10.

Figure 10:
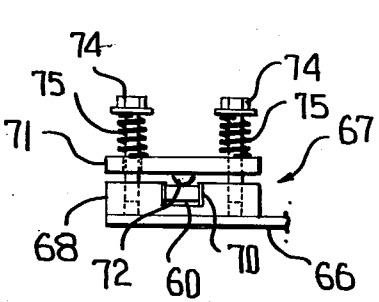
FIG. 10 is an enlarged fragmentary vertical sectional view showing specifically the connection between the pusher carriage and the chain.
Figure 11:
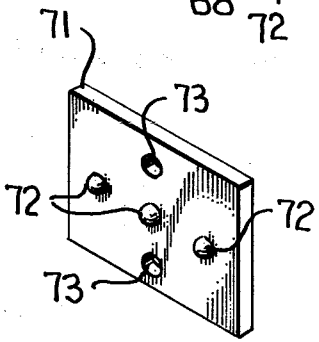
FIG. 11 is an enlarged perspective view of the upper clamp plate for interlockingly engaging the conveyor chain.

Referring now to FIG. 10, it will be seen that the slip coupling 67 includes a plate 68 which is suitably secured to the horizontal flange of the angle member 66. The plate 68 has a notch 70 therein in which the chain 60 is generally positioned. Overlying the plate 68 is a clamp plate 71 which is best illustrated in FIG. 11. The clamp plate 71 has a pair of fastener receiving openings 72 therein. Intermediate the fastener receiving openings and formed on the underside of the plate 71 is a row of projections 73 which are generally rounded and which are adapted to be received within the links of the chain 60 in the general manner of teeth of a sprocket.

Referring once again to FIG. 10, it will be seen that extending upwardly from the plate 68 is a pair of threaded fasteners 74. The fasteners 74 freely pass through the holes 72 and the plate 71 so that the plate 71 is mounted on the fasteners 74 for guided movement towards and away from the plate 68. Carried by each fastener 74 is a compression spring 75 which engages the upper surface of the plate 71 and constantly urges the plate 71 towards the plate 68, clamping the chain 60 in position within the groove 70. By adjusting the fasteners 74, the compression applied against the plate 71 may be adjusted, thereby adjusting the clamping pressure of the plate 71 with respect to the chain 60.

It will be understood that the inner engagement of the projections 73 with the chain 60 is such that under the normal operation of the conveyor mechanism 28, the chain 60 will drive the angle member 66 and thus drive the carrier 51. However, when the log which is being pushed by the push bar 30 becomes jamed or otherwise meets a resistance to movement greater than normal, in order to minimize the possibility of damage to the machine, the plate 71 will move upwardly against the pressure of the spring 75 and permit the chain 60 to run through the groove 70 and the plate 68.

It is also pointed out here that although the conveyor mechanism 28 has found to be effective to move a log through the various saw blades and molding heads, it may be desired to associated with the trough 23 a further conveyor chain which is operable to hold the forward end of a log against vertical deflection, thereby assuring against deflection of the log at the time it is engaged by the saw blades 31.

Although only a preferred embodiment of the invention has been specifically illustrated and described herein, it is to be understood that minor variations may be made in the cant forming machine without departing from the spirit and scope of the invention as defined by the appended claims.

What is claimed as new:

1. A cant forming machine comprising a first log support for initially defining a longitudinal log path, first saw means for forming in a log lower portion a pair of longitudinally extending first cant defining cuts, said first saw means including a pair of horizontally disposed rotary first saws disposed in opposed predetermined spaced relation, said first saws being disposed adjacent one end of said first log support, a longitudinally extending second log support disposed adjacent said first saws, said second log support disposed adjacent said first saws, said second log support including transversely spaced support portions coplanar with said first saws for reception in first cuts in a log for both supporting a log and defining a continuation of said log path, and other saw means spaced along said log path continuation for forming other cant defining cuts, said other saw means including other pairs of rotary saws arranged in horizontal planes vertically spaced from said first saws and from each other, saws of said other pairs of saws being in said opposed predetermined spaced relation.

2. The machine of claim 1 wherein said other saws also include a pair of vertically disposed saws transversely spaced said predetermined spacing and aligned with opposed edges of said horizontally disposed saws for simultaneously cutting a center cant from a log and separating from a log cants defined by said horizontally disposed saws.

3. The machine of claim 2 wherein disposed intermediate ends of said second log support is a horizontal planing head for planing the underside of a log to define a planed lower horizontal surface spaced a predetermined distance below said first cant defining cuts, and a third log support disposed downstream of said second log support for engagement by a planed lower horizontal log surface.

4. The machine of claim 3 wherein said third log support extends longitudinal between said vertically disposed saws.

5. The machine of claim 3 together with vertical planing heads positioned for planing vertical surfaces on a log only below said first cant defining cuts and transversely spaced a distance greater than said predetermined spaced relation of said first saws.

6. The machine of claim 1 wherein disposed intermediate ends of said second log support is a horizontal planing head for planing the underside of a log to define a planed lower horizontal surface spaced a predetermined distance below said first cuts, and a third log support disposed downstream of said second log support for engagement by a planed lower horizontal log surface.

7. The machine of claim 6 together with vertical planing heads positioned for planing vertical surfaces on a log only below said first cant defining cuts and transversely spaced a distance greater than said predetermined spaced relation of said first saws.

8. The machine of claim 1 together with feed means for feeding a log along said path, said feed means including a support member, guide means mounting said support member for movement longitudinally of said path, drive means for moving said support member forward and rearward along said guide means, a pusher member, and means mounting said pusher member for free forward pivotal movement during rearward movement of said support member when said pusher member engages a log seated on said first log support.

9. The machine of claim 8 wherein said drive means includes an endless drive element, means by moving said drive element first in one direction and then in reverse, and a controlled slip connection between said support member and said drive element.

10. The machine of claim 9 wherein said drive element is in the form of a chain, said slip connection includes a pair of opposed clamp plates, means resiliently urging said clamp plates together, and chain engaging projections on at least one of said clamp plates.

11. The machine of claim 1 together with positioning means for vertically positioning said first log support in accordance with log diameter.

12. The machine of claim 1 wherein said first log support is of a construction for receiving a bark bearing log, and said first saws and said other pairs of saws are positioned relative to said first log support for directly sawing a bark bearing log.

13. The machine of claim 2 wherein said first log support is of a construction for receiving a bark bearing log, and all saws of said first saw means and said other saw means are positioned relative to said first log support for directly sawing a bark bearing log.

* * * * *